US009414640B2

(12) United States Patent
Nichols

(10) Patent No.: US 9,414,640 B2
(45) Date of Patent: Aug. 16, 2016

(54) CYCLING SHOE

(76) Inventor: Colt Carter Nichols, Auberry, CA (US)

( * ) Notice: Subject to any disclaimer, the term of this patent is extended or adjusted under 35 U.S.C. 154(b) by 1050 days.

(21) Appl. No.: 12/848,994

(22) Filed: Aug. 2, 2010

(65) Prior Publication Data

US 2012/0023783 A1 Feb. 2, 2012

(51) Int. Cl.
*A43B 5/14* (2006.01)
*A43B 11/00* (2006.01)

(52) U.S. Cl.
CPC ..... *A43B 5/14* (2013.01)

(58) Field of Classification Search
CPC ..... A43B 5/14; A43B 5/145; A43B 11/00; A43B 11/02
USPC ..... 36/131, 11.5, 138, 50.1, 105, 97, 119.3, 36/118.311
See application file for complete search history.

(56) References Cited

U.S. PATENT DOCUMENTS

| | | | | | |
|---|---|---|---|---|---|
| 64,205 | A | | 4/1867 | Deitz | |
| 171,301 | A | * | 12/1875 | McKee | 36/50.1 |
| 474,574 | A | * | 5/1892 | Bruzon | 36/138 |
| 1,068,942 | A | | 7/1913 | Siegel | |
| 1,114,435 | A | | 10/1914 | Batten | |
| 1,171,689 | A | | 2/1916 | Allen | |
| 1,686,175 | A | * | 10/1928 | Read | 36/58.5 |
| 2,069,752 | A | * | 2/1937 | Dorr | 36/11.5 |
| 2,147,197 | A | * | 2/1939 | Glidden | 36/9 R |
| 2,188,603 | A | | 1/1940 | Hamalainen | |
| 2,252,315 | A | * | 8/1941 | Doree | 36/9 R |
| 2,357,980 | A | | 9/1944 | Spiro | |
| 2,452,649 | A | * | 11/1948 | Graves | 36/138 |
| 3,192,651 | A | * | 7/1965 | Smith | 36/105 |
| 3,295,177 | A | * | 1/1967 | Bruckl | 24/70 R |
| 3,681,860 | A | * | 8/1972 | Bidegain | A43B 3/30 36/112 |
| 4,095,356 | A | | 6/1978 | Robran et al. | |
| 4,541,147 | A | * | 9/1985 | Olivieri | 24/68 SK |
| 4,916,834 | A | | 4/1990 | Baggio et al. | |
| 4,941,273 | A | | 7/1990 | Gross | |
| 4,969,277 | A | | 11/1990 | Williams | |
| 5,184,410 | A | | 2/1993 | Hamilton | |
| 5,467,537 | A | * | 11/1995 | Aveni et al. | 36/50.1 |
| 5,481,814 | A | | 1/1996 | Spencer | |
| 5,555,650 | A | | 9/1996 | Longbottom et al. | |
| 5,604,998 | A | * | 2/1997 | Kita | 36/69 |
| 5,657,557 | A | | 8/1997 | Hull et al. | |
| 5,819,442 | A | * | 10/1998 | Orso | 36/118.3 |
| 6,290,559 | B1 | * | 9/2001 | Scott | 441/64 |
| 6,477,793 | B1 | | 11/2002 | Pruitt et al. | |
| 6,938,361 | B2 | * | 9/2005 | Su | 36/105 |
| 7,062,867 | B2 | | 6/2006 | Meibock | |

(Continued)

*Primary Examiner* — Robert J Hicks
*Assistant Examiner* — Timothy K Trieu
(74) *Attorney, Agent, or Firm* — John F. Guay

(57) ABSTRACT

A cycling shoe includes a sole having a toe section, a ball section, an arch section, and a heel section. An upper is connected to the sole to provide a cavity for receiving a foot of a cyclist, and a heel is pivotable relative to the sole by way of a lower portion of the heel being connected to the heel section of the sole. An upper portion of the heel can be rotated between selectable bistable open and closed positions by rotating the heel about a pivot area of the lower heel portion. In the closed position, the cyclist's foot can be secured to the cycling shoe using a fastening system that includes connecting elements extending from the heel and at least one tensioning device on the upper that cooperates with the connecting elements. The connecting elements can be adjusted such that the heel is in tension with the upper with a cyclist's foot therebetween.

24 Claims, 4 Drawing Sheets

(56) References Cited

U.S. PATENT DOCUMENTS

| | | | | |
|---|---|---|---|---|
| 7,439,837 | B2 * | 10/2008 | McDonald | 36/11.5 |
| 7,685,747 | B1 * | 3/2010 | Gasparovic et al. | 36/102 |
| 2002/0095823 | A1 * | 7/2002 | Laio et al. | 36/138 |
| 2004/0148809 | A1 * | 8/2004 | Kikuta et al. | 36/131 |
| 2005/0210712 | A1 * | 9/2005 | Jau et al. | 36/131 |
| 2007/0033836 | A1 | 2/2007 | Rasmussen | |
| 2007/0089945 | A1 | 4/2007 | Martignago | |
| 2007/0113428 | A1 * | 5/2007 | Jau et al. | 36/131 |
| 2008/0016723 | A1 | 1/2008 | De Bast et al. | |
| 2008/0168683 | A1 | 7/2008 | Keating | |
| 2008/0276492 | A1 | 11/2008 | Burnett | |
| 2008/0276496 | A1 * | 11/2008 | Kerns et al. | 36/131 |
| 2010/0319216 | A1 * | 12/2010 | Grenzke et al. | 36/54 |

* cited by examiner

CYCLING SHOE

FIELD OF THE INVENTION

The invention relates to a cycling shoe, and in particular, a cycling shoe having a pivoting heel portion.

BACKGROUND

Triathlons are races that consist of three different segments, or legs: swimming, cycling and running. The length of a race leg can vary depending on a particular triathlon, for example, from relatively short and easily performed (e.g., novice events) to long and grueling distances (e.g., an Ironman™ triathlon event). In all triathlons, transition areas are positioned between consecutive legs of the race and are used to store racing equipment, such as bicycles, helmets, shoes, water and other apparel and gear needed for a next leg of the race. Racers also can use a transition area to discard gear used in a just completed leg, but not needed in a following leg (e.g., discarding a wet suit after completing a swimming leg before beginning a cycling leg).

To reduce an overall time for completing a race, triathletes attempt to reduce the amount of time spent in a transition area. A first transition time (T1), which is time elapsed while in a transition area between the swim and bike segments, can be used to remove a wetsuit, strap on a helmet, slip on a pair of cycling shoes, and mount a bicycle. A second transition time (T2) is the time spent in the transition area between the bike leg and run leg of the race, and can be used to park the bicycle, remove the helmet and cycling shoes, and put on running shoes.

Hence, critical time is spent donning and removing cycling shoes in the T1 and T2 transition times. Conventional cycling/triathlon shoes have a very wide top entry with minimal Velcro or plastic straps as means of securing the foot in the shoe. The heel portion of the shoe is immobilized to accomplish maximum firmness and power transfer. These cycling shoes can include a loop attached to, or integrated with the heel to facilitate inserting the cyclist's foot into the shoe by pulling the loop backward and upward while the foot is inserted into the top entry.

SUMMARY

Embodiments consistent with the claimed inventions relate to a cycling shoe that has a movable heel, which can selectively be placed into one of two available stable states, or bistable states. In one state, the heel is in an open position and allows entry and removal of a cyclist's foot through the rear of the shoe. In the closed state, the cycling shoe can be secured to a cyclist's foot because the heel includes connecting elements that can be held in tension with the upper using one or more tensioning devices connected to the upper. Bistability is provided because the heel forms a curved surface with attachment to a heel section of the sole. While the heel remains bendable, it must overcome an energy barrier with movement between open and closed states. Thus, the heel can readily be placed into one bistable state and remain that state until moved again to the other bistable state.

More specifically, a cycling shoe consistent with the claimed invention includes a sole having a toe section, a ball section, an arch section, and a heel section. An upper is connected to the sole to form a cavity for receiving a foot of a cyclist and includes first and second peripheral edge portions. A heel including a first lateral side, a second lateral side, a lower heel portion is connected to the heel section of the sole and an upper heel portion pivotable to selectively rotate the heel into bistable open and closed positions with respect to the sole about a pivot area of the lower heel portion, where the pivot area is adjacent to where the lower heel connects to the heel section of the sole. The cycling shoe includes a fastening system having a first connecting element extending from the first lateral side of the heel, a second connecting element extending from the second lateral side of the heel, and at least one tensioning device on the upper. The at least one tensioning device cooperates with the first and second connecting elements to provide a tension relationship between the heel in the closed position and the upper with a cyclist's foot therebetween. With the heel in the closed position, the first and second peripheral edge portions respectively face the first and second lateral sides of the heel, an area between the first peripheral edge portion of the upper and the first lateral side of the heel and an area between the second peripheral edge portion of the upper and the second lateral side of the heel are substantially open. Each of the open areas extends at least substantially entirely to the sole.

In another embodiment consistent with the claimed invention, a cycling shoe includes a sole having an inner side and an outer side. The inner side includes a toe section, a ball section, an arch section, and a heel section. The outer side includes a mounting section including plural orifices for connecting a cleat. An upper of the cycling shoe is connected to the sole to form a cavity for receiving a foot of a cyclist. A heel of the cycling shoe includes a first lateral side, a second lateral side, a lower heel portion connected to the heel section of the sole, and an upper heel portion pivotable to selectively rotate the heel into bistable open and closed positions with respect to the sole about a pivot area of the lower heel portion. The cycling shoe includes a fastening system having a first connecting element extending from the first lateral side, a second connecting element extending from the second lateral side, and at least one tensioning device on the upper. The at least one tensioning device cooperates with the first and second connecting elements to provide a tension relationship between the heel, while in the closed position, and the upper with a cyclist's foot therebetween.

It is to be understood that both the foregoing general description and the following detailed description are exemplary and exemplary only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION

The various aspects are described hereafter in greater detail in connection with a number of exemplary embodiments to facilitate an understanding of the invention. However, the invention should not be construed as being limited to these embodiments. Rather, these embodiments are provided so that the disclosure will be thorough and complete, and will fully convey the scope of the invention to those skilled in the art. Descriptions of well-known functions and constructions are omitted for clarity and conciseness. Further, it should be emphasized that the terms "comprises" and "comprising," when used in this specification, are taken to specify the presence of stated elements, features, integers, steps or components; but the use of these terms does not preclude the presence or addition of one or more other elements, features, integers, steps, components or groups thereof.

Competition and pressure for reducing time has led to the development of specialized triathlon clothing that is adequate for both swimming and cycling, meaning many racers' transitions consist of little more than removing wetsuit and goggles and pulling on a helmet and cycling shoes. In some cases, racing cyclists leave shoes attached to their bicycle pedals (e.g., clipless configurations) and slip their feet into them while riding, while other racers prefer putting cycling shoes on before mounting their bicycles. In either case, the inventor has recognized that reducing the time spent at a transition area while providing ease of performing the transition can be a critical element in the outcome of a race or other event that involves rapid donning of cycling footwear.

Figure 1:
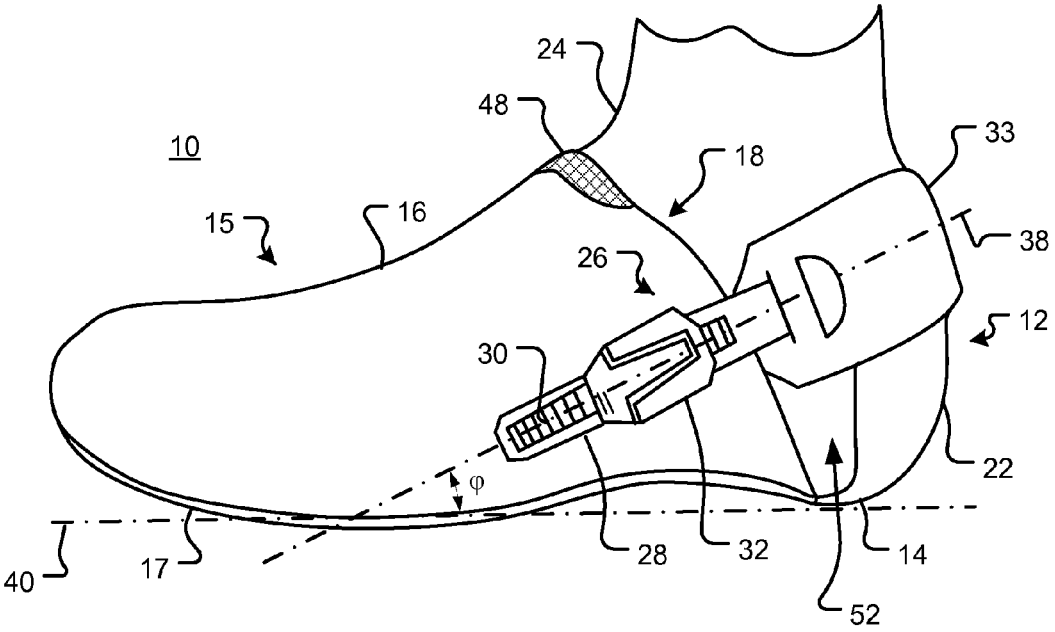
FIG. 1 is a side view diagram of a cycling shoe with a pivoting heel portion in a closed position according to an exemplary embodiment.
Figure 2:
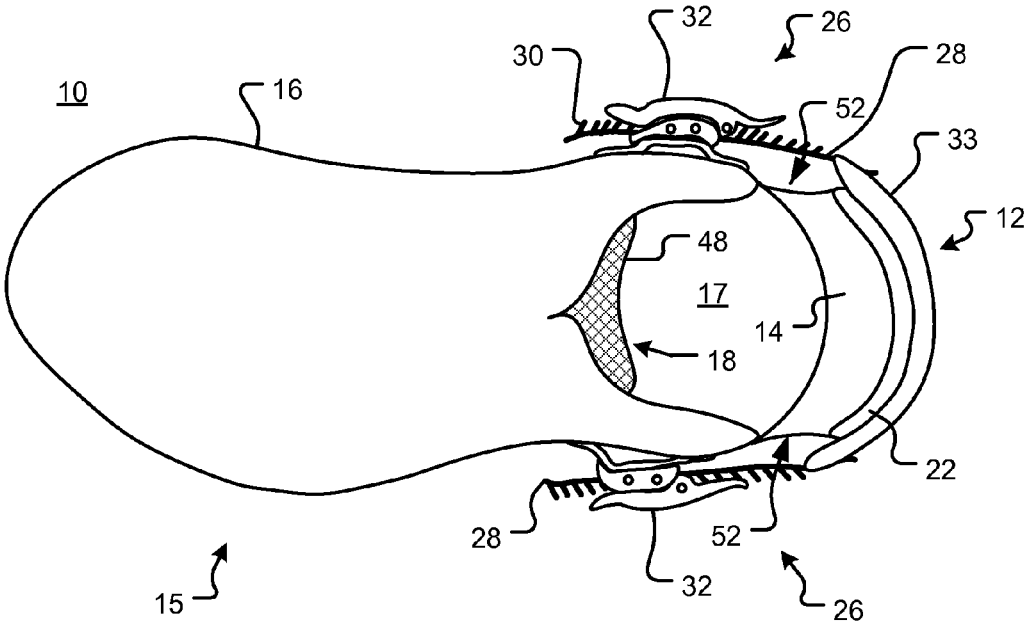
FIG. 2 is a top view diagram of the cycling shoe shown in FIG. 1 with the pivoting heel portion in a closed position.

With reference now to FIGS. 1 and 2, a cycling shoe according to an exemplary embodiment is now described. FIGS. 1 and 2 respectively show a side and top view of a cycling shoe 10, such as a triathlon cycling shoe, which includes a main shoe portion 15 including an upper portion (or upper) 16, a sole 17, and a pivotable heel 12 connected to the sole 17. The sole 17 has upper and lower outer surfaces that include a toe section, a ball section, an arch section, and a heel section. The upper 16 covers the toe, ball and arch sections of the sole 17. The pivotable heel 12 includes a heel portion 22 that can be pivoted about a crease area 14 along a bottom portion thereof to position the pivotable heel 12 between an open position in which a cyclist's foot 24 can be inserted into a cavity 18 formed by the upper 16 and the sole 17 attached to the upper 16, and a closed position in which the heel portion 12 faces the cavity 18 and can be fastened to the upper 16 to secure the cycling shoe 10 to the foot 24.

In the closed position, the heel portion 22 of pivotable heel 12 engages a cyclist's heel and is in a tension relationship with the upper 16 to secure the cyclist's foot in the upper 16. The heel portion 22 is flexible and can be a molded structure. For example, the heel portion can be made of natural materials such as leather, polymeric woven materials, plastic, rubber, synthetic rubber or combinations thereof, and can be formed using the same material as the upper 16 of the main shoe portion 15, although the upper 16 and heel portion can be formed of different materials.

The cycling shoe 10 includes a fastening mechanism 26 for removably attaching the pivotable heel portion 12 to the upper 16 and providing the tension relationship between strap retaining portion 33 of the pivotable heel 12 and the main shoe portion 15 in a position that secures the cycling shoe 10 to the cyclist's foot 24. In the exemplary embodiment shown in FIGS. 1 and 2, the fastening mechanism 26 includes a strap 28 provided on each side of the cycling shoe 10. Each strap 28 can be a ratchet cinch type strip having teeth, ridges or notches 30 that are provided along at least one side thereof and is designed to cooperate with a tensioning device 32, such as a ratcheting buckle device, although in some embodiments a fastening mechanism 26 can include straps that cooperate with a tensioning device 32 that do not include teeth, ridges or notches.

Each strap 28 can be attached to a strap retaining portion 33 that can be positioned at the back of the heel portion 22. The strap retaining portion can be attached to the heel portion using adhesive, stitching (thread), staples and/or rivets etc., or can be integrated with the heel portion 22. In other embodiments, a strap 28 can be a continuous strip threaded through the strap retaining portion 33 or across or though the heel portion 22, with ends of the continuous strip extending from each side of the strap retaining portion 33. With a continuous strip as the strap 28, a retaining element can be included, such as a rivet, stitching, adhesive, staple, one or more member extending from the continuous strip that engages a part of the strap retaining portion 33 or heel portion 22, or another retaining mechanism that can prevent the strap from being pulled off of the cycling shoe 10 with only one strap being pulled forward at a time.

To operate the fastening mechanism 26, after the cyclist's foot 24 is inserted into the cavity 18 provided by the upper 16 and the sole 17, or while inserting foot 24 into the cavity 18, the cyclist can grab a strap 28 on each side of the cycling shoe 10 and thread the ends of the straps 28 through each respective tensioning device 32. Next, the cyclist can pull each threaded end of a strap 28 further through the tensioning device 32 toward the toe cap in the longitudinal direction of the shoe and in a slightly downward direction until the pivotable heel 12 contacts the cyclist's heel. The ends of the strap 28 can be pulled through the tensioning device 32 to an extent in which the fit around the cyclist's heel is at least as snug, has a same firmness as would exist with a conventional top entry shoe, or to a desired tension amount that increases with increasing combined distances of the straps 28 pulled through the tensioning devices 32.

In some embodiments, as shown in FIG. 1, a central axis 38 of each strap 28 can be provided an angle $\phi$ to a horizontal line 40 that generally follows the bottom of the shoe 10 and passes through the lowermost parts of the sole 17 at the flex point at the ball of the foot and at the heel. In this way, the strap retaining portion 33 of the pivotable heel 12 tightens the heel portion 22 onto the heel of the cyclist's foot 24 near where the upper side of the cyclist's calcaneus bone and Achilles tendon meet to ensure a "lock" of the cycling shoe 10 on the cyclist's foot 24. To provide comfort and to further prevent movement of the foot 24 in the cycling shoe 10, the interior of cycling shoe 10 can be provided with linings or padding (not shown), although the shoe upper 16, inner portion of the sole 17, and/or the heel portion 22 can include little or no linings and/or padding.

Figure 3:
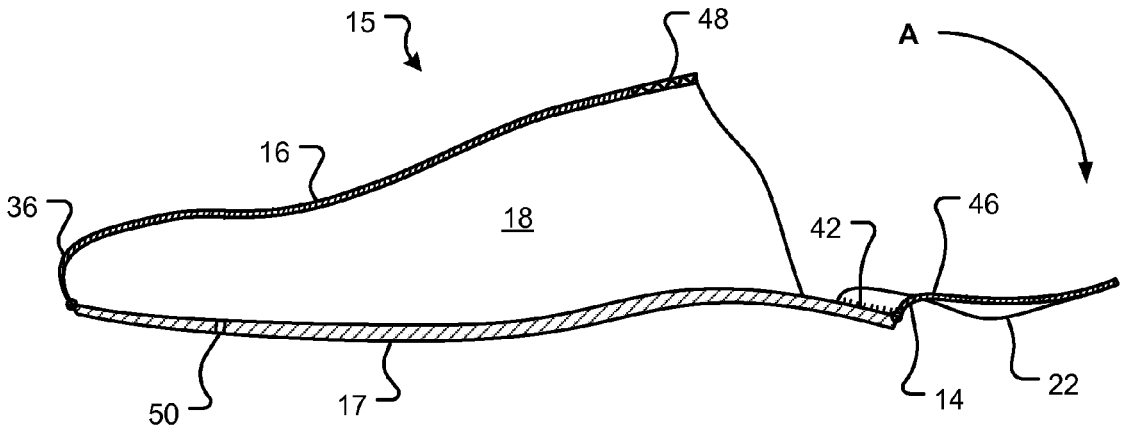
FIG. 3 is a cross-section view diagram of a cycling shoe having a pivoting heel portion in an open position according to an exemplary embodiment.

The cycling shoe 10 can generally function as a conventional cycling shoe, but is different from conventional cycling and triathlon bike shoes in that a pivotable heel 12 of the cycling shoe 10 can pivot relative the sole 17 at the crease area 14 to fold back and away from the interior cavity 18 of a main shoe portion 15 to allow rear entry of a cyclist's foot 24 into the cycling shoe 10. In a preferable embodiment, the cycling shoe 10 is configured for use in a known clipless, or cleat-and-pedal system, and can be mounted in the open position on a pedal of a cycle using such a system. In a clipless system, a cleat (not shown) is usually attached to the sole 17, via the mounting orifices, at a location under the ball of the cyclist's foot 24. Each pedal of the cyclist's bicycle includes a binding mechanism that receives the cleat mounted on the cycling shoe 10 to "lock in" the cleat and allow the cyclist to push or pull in virtually any direction during a cycle stroke. While the cross-section in FIG. 3 shows only one mounting orifice 50, it is to be understood that plural mounting orifices can be provided and that the location and number of mounting orifices is would be determined on which cleat-and-pedal system is utilized. In an embodiment, sole 17 can have an inner side and an outer side, where the inner side includes a toe section, a ball section, an arch section, and a heel section, and the outer side includes a mounting section having the plural orifices 50 (only one shown in FIG. 3) for connecting a cleat.

Figure 4:
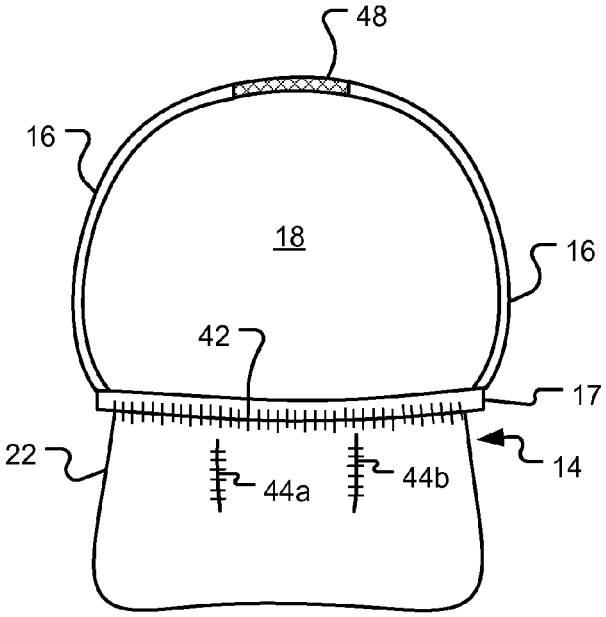
FIG. 4 is a rear view diagram of a cycling shoe having a pivoting heel portion in an open position according to an exemplary embodiment.

Additionally, the pivotable heel 12 can maintain its position in either an open or closed state. As shown in FIG. 2, the cross-section diagram of FIG. 3, and the rear view diagram of FIG. 4, the heel portion 22 is attached to a curved rear heel end of the sole 17 by stitching, adhesive, rivets, and/or staples, combinations thereof, or any known means of attaching heel elements to a sole of a shoe. In the exemplary embodiment shown in FIGS. 3 and 4, the heel portion 22 is shown attached to the sole 17 using stitching 42. Also shown in FIG. 4 is stitching 44*a* and 44*b*, which can be provided to shape the heel portion 22, although it is to be understood that the shape of the heel can be provided in other ways in other embodiments.

The combination of the curved shape of the heel of the sole 17 and attached heel portion 22 can provide bistable positioning as follows: in the upright, open position, the material of the heel portion following the curved heel portion of the sole 17 provides one state of minimal free energy, and when the heel portion 22 moved in a rotational direction A away from the toe 36 of shoe, the heel portion 22 overcomes a barrier and can make a transition from the closed state of minimal free energy to an open state of minimal free energy. In some embodiments, in the open state a dimple 46 can form in a center portion of the heel portion 22 after overcoming the barrier between the open and closed states to transform the interior surface of the heel portion 22 facing the upper 16 from a concave shape as shown in FIGS. 1 and 2 to the convex shape shown in FIG. 3. Thus, the heel portion 22 can be easily flipped by cyclist to rotate the heel portion 22 generally about 45 to 90 degrees in either direction to orient the pivotable heel 12 between the bistable open and closed positions. These stable states allow the cycling shoe to be attached to a bicycle pedal in the open state prior to the cyclist approaching the bicycle. For example, a bicycle having a cycling shoe 10 attached to each of its pedals can be provided at a transition area prior to the cyclist arriving at that transition area and the cyclist can insert her foot into the cavity 18 without any substantial interference from the heel portion 22 and begin to pedal the bike immediately thereafter. Alternatively, the shoe can be provided elsewhere in the transition area and the cyclist can quickly insert each of her feet into one of the waiting cycling shoes 10.

After the cyclist's foot is inserted into the main shoe portion 15, the heel portion 22 can moved in a rotational direction opposite to direction A so the heel portion 22 is pivoted relative to the sole 17 at the crease area 14 into the closed state where the heel portion is adjacent to the back of the heel of the cyclist's foot. The dimple 46 is removed as the heel portion transitions into the closed state. Thereafter, the cyclist can thread the straps 28 through the to provide a snug fit against the cyclist's heel to thereby secure the cyclist's foot 24 in the cycling shoe 10. In another embodiment, the length of each strap 28 can be sufficiently long and flexible to allow the straps 28 to remain in a respective tensioning device 32 while the pivotable heel 12 is in the open state. Further, some embodiments can include a connection between the straps 28 on each cycling shoe 10 so the rider can pull both straps 28 simultaneously. Strap ends having a connection therebetween also would prevent the strap ends from interfering with the pedaling mechanisms, such as the chain and sprockets. In any of these embodiments, the cyclist can reduce an amount of elapsed transition time while mounting a bicycle because the cyclist's foot can be inserted into the shoe and the cyclist can begin pedaling virtually immediately. Further, the straps 28 can be easily pulled as soon as the cyclist's foot is inserted into the main shoe portion 15 or at any later time while pedaling, for example, while in or after exiting a transition area.

The upper 16 of the main shoe portion 15 can be made of natural materials such as leather, polymeric woven materials. The upper 16 is preferably shaped to form a snug, tight or substantially tight fit of the cyclist's foot 24 with the cycling shoe secured to the foot 24, and is not designed to be opened at the top as with conventional top entry cycling shoes. Some embodiments of the cycling shoe 10 can have tensioning mechanisms over the top of the front of the shoe 10 (not shown), but this is strictly for ensuring a snug or tight fit of the cycling shoe around the cyclist's foot and not a mechanism that allows the cyclist to take off or put on the shoe 10. Additionally, the upper 16 can have a seamless interior to allow for efficient water drainage, and can include openings (e.g., holes) and areas or patches of mesh material or otherwise breathable material in at least one or more locations thereof.

The sole (or outsole) 17 of the main shoe portion 15 is preferably made low weight, high strength, stiff, or substantially rigid material, such as a carbon composite (e.g., carbon fiber, carbon/glass fiber), plastics (e.g., nylon or fiberglass reinforced nylon), rubber, or combinations thereof, to provide of sufficient stiffness index for efficient translation of power from the sole 17 of main shoe portion 12 to a surface of a bicycle pedal. In some embodiments, a stiffness index of the sole can be about 5.0 or greater to provide efficient power transfer, although some embodiments can have a sole stiffness exceeding 5.0, e.g., from 7.0 to 12.0, to provide more efficient power transfer from the cyclist's legs, to the sole 17, and to a pedal of the bicycle. Because advances in pedal designs have resulted in smaller, lightweight pedals having a reduced usable area for contact with a shoe sole, material for sole 17 can be chosen to have a sufficiently high stiffness index to distribute forces where a small pedal area meets the sole 17. This can provide comfort for the cyclist's foot as well as provide more efficient power transfer compared with more flexible, lower stiffness index soles.

For example, an embodiment using a carbon composite for high strength, stiff and light weight sole 17 can use a different material, such as rubber, leather, plastic, cloth, canvas, or another material for the heel portion. For example, an embodiment can include a high performance sole such as a carbon composite sole and also include an anti slip rubber outer surface on the lower heel portion 22 of the cycling shoe 10 to provide stability to the cyclist when the cyclist's foot is put down on the ground. In other embodiments, the lower heel portion 28 and the upper 16 of the main shoe portion 15 can be provided with breathable material, such as a mesh patches (not shown) or another breathable fabric that allows air to circulate, allowing water and sweat to evaporate. In some embodiments, an expandable mesh material or neoprene, for example, can be provided to allow stretching or expanding the shoe cavity 18 or heel portion 12. For example, FIGS. 2 to 4 show a mesh material 48 provided on the upper 16 at the entrance of the cavity 18.

It can be readily seen from FIGS. 1-4, an act of tightening both ends of the strap 28 can be performed by a cyclist using each hand a respective strap end simultaneously, which can be in rapid fashion to reduce the transition time T1. Similarly, transition time T2 can be reduced by rapidly removing the cyclist's foot 20 from the cycling shoe 10 during an operation of the tensioning device 32, which releases the engaging mechanism of the tensioning device from the teeth, ridges or notches 30 of the strap 28. For example, the cyclist can remove his or her foot 24 from the cavity 18 while manipulating a quick release buckle.

In a preferred embodiment, the cycling shoe 10 can include an open area 52 positioned between the pivotable heel 12 and the main shoe portion 15, which can promote quick drainage of residual water from a swimming leg of a race and/or ventilation of the cycling shoe. Accordingly, the cycling shoe 10 can be more amenable to cycling in bare feet which can reduce a T1 transition time because a cyclist can avoid wearing socks or drying feet before insertion into the cycling shoe 10. Additionally, the open area 52 can reduce overall weight of the cycling shoe, and/or eliminate pinching or abrasive action that can occur if the sidewall of the pivotable heel 12 were to contact the sidewall of the upper 16 of the main shoe portion 15.

The fastening mechanism that secures the pivotable heel 12 of the cycling shoe to the cyclist's foot can include a configuration other than a strip that threads through a tensioning device. FIGS. 5 to 7C show exemplary embodiments of a cycling shoes 110*a* and 110*b*, for example triathlon cycling shoes, which use a detachably connectable hook and loop type fastener (e.g., Velcro™). The cycling shoe 110 has similar elements as shown in FIGS. 1-4, with slight modifications, and therefore similar reference numerals (i.e., those with 100 added to a reference number described above) will be used for the same elements. Unless described otherwise, similarly numbered items can be as described above.

Figure 5:
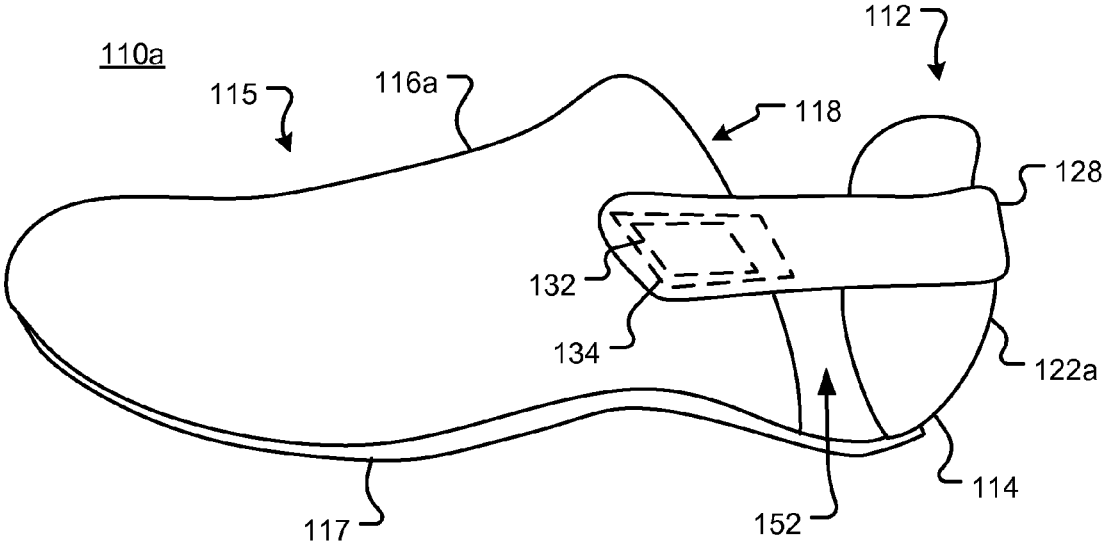
FIG. 5 is a side view diagram of the cycling shoe having a pivoting heel portion in a closed position according to another exemplary embodiment.

With reference now to FIG. 5, a cycling shoe 110*a* includes a main shoe portion 115 including an upper 116*a*, a sole 117, and a pivotable heel 112 connected to the sole 117. The pivotable heel 112 includes a heel portion 122*a* that can be pivoted about a crease area 114 along a bottom portion thereof to position the pivotable heel 112 between an open position in which a cyclist's foot can be inserted into a cavity 118 formed by the upper 116*a* and the sole 117 attached to the upper 116*a*, and a closed position in which the heel portion 122*a* faces the cavity 118 and can be fastened to the upper 116*a* to secure the cycling shoe 110*a* to a cyclist's foot (not shown).

In the closed position, the heel portion 122*a* of pivotable heel 112 can engage a cyclist's heel in a tension relationship with the upper 116*a* to secure the cyclist's foot in the upper 116*a*. The fastening mechanism for cycling shoe 110*a* differs from the that described above in that the tension relationship between the main shoe portion 115 and the heel portion 112 is provided by connecting the straps 128 connected to the pivotable heel 112 to the main shoe portion 115 using, on each side of the shoe 110*a*, loop (or hook) surface 132 on the strap 128 and a hook (or loop) surface 134 and main shoe portion 116. As described herein, the heel portion 112*a* of pivotable heel 112 is connected to the sole 117 such that it is bistable can be positioned into either the open or closed position.

Figure 6:
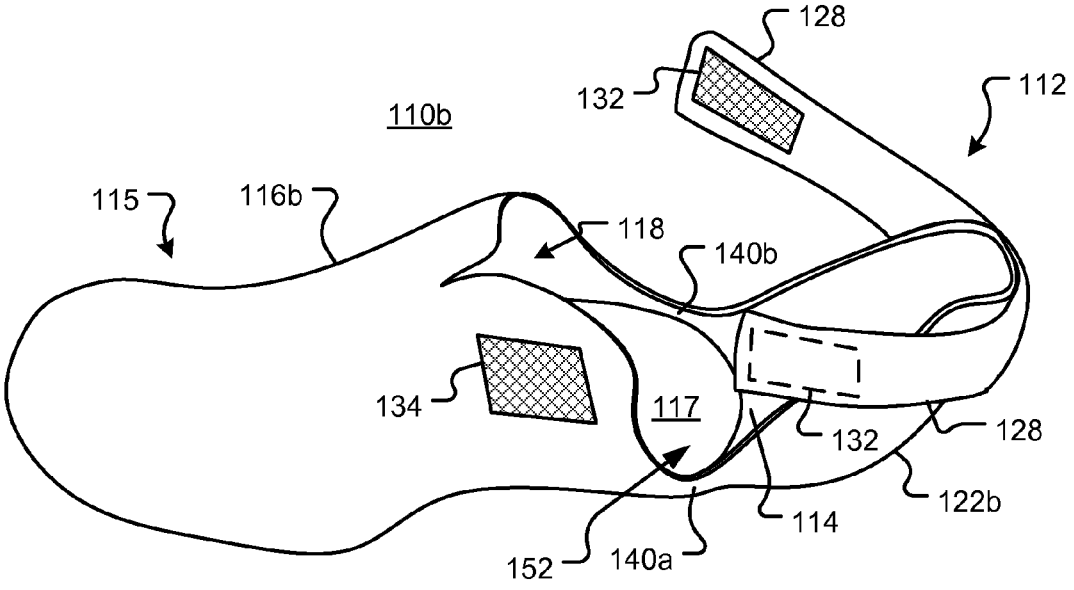
FIG. 6 is a perspective view diagram of a cycling shoe having a pivoting heel portion in an open position according to another exemplary embodiment.

FIG. 6 is a perspective diagram of a cycling shoe 110*b* according to another exemplary embodiment. The cycling shoe 110*b* is similar to the cycling shoe 110*a*, except the upper 116*b* and the pivotable heel 122*b* are formed from continuous material. That is, the upper portion 116*b* and the heel portion 122*b* have connecting segments 140*a* and 140*b*, which can be formed by creating an area 152 between the heel portion 122*b* and the upper 116*b*.

Figure 7A:
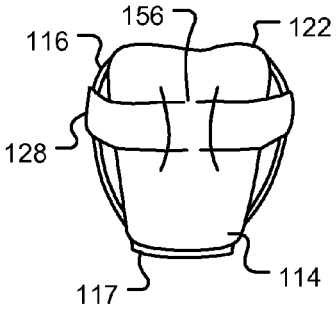
FIGS. 7A to 7C are rear view diagrams of cycling shoes, each showing an exemplary strap and a pivoting heel portion configuration.
Figure 7B:
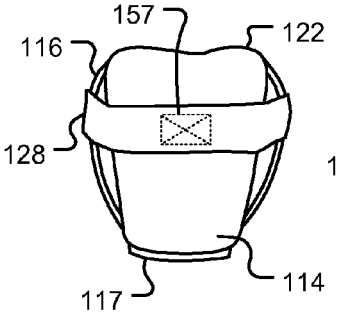
Figure 7C:
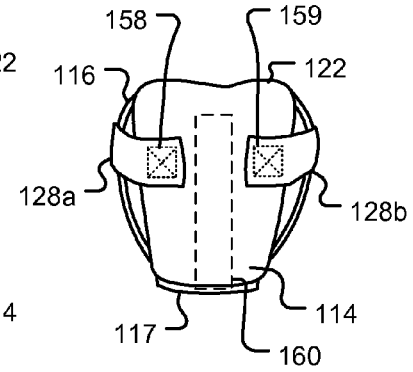

FIGS. 7A to 7C show exemplary strap configurations that can be used in any of the forgoing embodiments. In FIG. 7A, the heel portion 122 includes openings though which a passageway 156 is formed for attaching a continuous strap 128 to the heel portion 122. While not shown, the strap can include a retaining element, such as a molded hook or rivet, to prevent the strap 128 from sliding out of the passageway 156. FIG. 7B shows an exemplary configuration in which a single continuous strip is attached to an outer surface of the heel portion 122, for example, by using stitching 157. FIG. 7C shows an exemplary embodiment in which separate strap sections 128*a* and 128*b* are connected to the heel portion 122 via stitchings 158 and 159, respectively.

Figure 8:
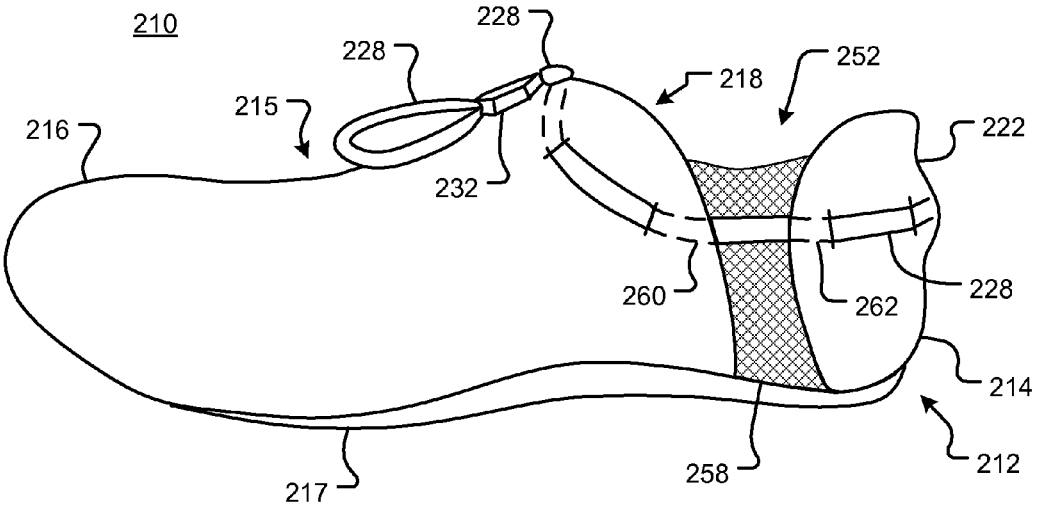
FIG. 8 is a side view diagram of the cycling shoe having a pivoting heel portion in a closed position according to another exemplary embodiment.

FIG. 8 is a side view diagram of a cycling shoe 210 according to another exemplary embodiment. The cycling shoe 210 has elements similar to those shown in FIGS. 1-4, with slight modifications, and therefore similar reference numerals (i.e., those with 200 added to a reference number described above with respect to FIGS. 1-4) will be used for the similar elements. Unless described otherwise, similarly numbered items can be as described above.

With reference to FIG. 8, a cycling shoe 210 includes a main shoe portion 215 including an upper 216, a sole 217, and a pivotable heel 212 connected to the sole 117. The pivotable heel 212 includes a heel portion 222 that can be pivoted about a crease area 214 along a bottom portion thereof to position the pivotable heel 212 between an open position in which a cyclist's foot can be inserted into a cavity 218 formed by the upper 216 and the sole 217 attached to the upper 216, and a closed position in which the heel portion 212 faces the cavity 218 and can be fastened to the upper 116 in a tension relationship to secure the cycling shoe 210 to a cyclist's foot (not shown).

An opening 252 is provided between the upper 216 and the pivotable heel 212 and includes elastic mesh material 258 that can assist in retracting the pivotable heel 212 from the open position through to the closes position, although the opening can be left open or include another kind of elastic material. For the purposes of this application, with the depicted openings 252, 152 and 52 including a mesh or another breathable and elastic filler material, the opening is a substantially open area, although a substantially open area also includes an opening having no such filler material. Further, although the upper 216 and the heel portion 222 are shown as separate portions, these portions can include a connecting portion between them at the bottom of the opening 252, such as described above in connection with FIG. 6.

The fastening mechanism for cycling shoe 210 differs from those described above in that the tension relationship between the main shoe portion 215 and the heel portion 212 is provided by a cord 228, such as an elastic cord, (e.g., a rubberized "bungee" type chord), or any other elastic type of cord. The cord 228 can be threaded though one or more passageway 260 in or on the upper 216, and one or more passageway 262 in or on the heel portion 222. Alternatively, the cord 228 can be threaded through eyelets, loops or any other known device connected to the cycling shoe 210 that can retain the cord to the upper 215 and the pivotable heel 212.

At the top side of the shoe is a tensioning device 232 through which the cord 228 is threaded. The cord 228 is sufficiently long to allow an end section thereof to protrude from the tensioning device 232 while the pivoting heel 212 is in the open bistable position and permit the cyclist to grab the end section to pull the cord through the tensioning device 232 to an extent necessary to bring the heel portion 222 into a tensioning relationship with the upper 216. The tensioning device 232 can be connected to the upper 216 to allow for a one handed rapid tensioning operation. The tensioning device 232 can include a quick release mechanism that allows the cyclist to rapidly release the cord in the tensioning device and permit retraction of the pivotable heel 212 and withdrawal of the cyclist's foot from the cycling shoe 210.

Those in the art will recognize various modifications can be made to the exemplary embodiments described herein. For example, an element capable of being manipulated into at least two states can be used in addition to a heel portion to provide open and closed orientation of a pivotable heel. Returning to FIG. 7C, for example, an embodiment can include a bistable element 160 that can be included in or on the heel portion 122. The bistable element 160 can be manipulated to move it into either a closed or open position. The bistable element 160 can be used in any embodiment and comprise a normally curved material that can maintain the pivotable heel 22, 122*a*, 122*b* and 222 in an upright stable closed position and be bent in a direction away from the toe into a second stable and open position. The heel portion 122 can include the bistable element 160, for example, as an attachment to the strap retaining portion 33, as a bistable state strip sewn into the heel portion 22, 122, 222, and/or the additional element can form part of the attachment of the heel portion 22, 122, 222 to the sole 17, 117 and 217.

Embodiments of cycling shoes consistent with the claimed invention allow for rapid entry a cyclist's foot into the cycling shoe, and rapid fastening and securing of the cycling shoe to the cyclist's foot. The claimed cycling shoe also can allow for quick unfastening and removal of the cyclist's foot from the cycling shoe. Additionally, exemplary embodiments described herein can be readily modified for use with any particular type of cleat and/or pedal system, or embodiments of the cycling shoe can include no cleats. While a "bicycle" has been described above in various embodiments, the clamed cycling shoe can be used with any type of cycling machine in which pedaling is required for operation. The claimed invention is particularly suitable for use in racing applications, such as triathlon races, where transitions from occur between cycling and at least one sport activity other than cycling (e.g., swimming or running), although the cycling shoe can be applied to other types of cycling activity where no such transition occurs.

Although a limited number of embodiments is described herein, one of ordinary skill in the art will readily recognize that there could be variations to any of these embodiments and those variations would be within the scope of the appended claims. Thus, it will be apparent to those skilled in the art that various changes and modifications can be made to the cycling shoe described herein without departing from the scope of the appended claims and their equivalents.

What is claimed is:

1. A cycling shoe, comprising: a sole having a toe section, a ball section, an arch section, and a heel section including a curved rear heel end;

an upper connected to the sole to form a cavity for receiving a foot of a cyclist and including first and second peripheral edge portions;

a heel including a first lateral side, a second lateral side, a flexible lower heel portion connected to the heel section of the sole and an upper heel portion pivotable to selectively rotate the heel into bistable states respectively corresponding to open and closed states of the heel with respect to the sole about a pivot area of the lower heel portion, said pivot area adjacent to where the lower heel portion connects to the heel section of the sole, a concave portion of an interior surface of the heel in the closed state transforms to be a convex portion of said interior surface in the open state in a transition of the heel from the closed state to the open state, the heel including a first energy barrier between the open state and the closed state and a second energy barrier between the closed state and the open state, and the heel remains in the open state until moved to overcome the first energy barrier and placed into the closed state and remains in the closed state until moved to overcome the second energy barrier and placed into the open state; and a fastening system including a first connecting element extending from said first lateral side, a second connecting element extending from said second lateral side, and at least one tensioning device on the upper, said at least one tensioning device cooperating with the first and second connecting elements to provide a tension relationship between the heel in said closed state and the upper, wherein the connection of the flexible lower heel portion to the heel section of the sole is curved as a result of the connection extending along a portion the curved rear heel end, and with the heel in said open state, said interior surface flexes to form a crease including the convex surface in the pivot area of the lower heel portion.

2. The cycling shoe of claim 1, wherein the upper and heel are separate from each other.

3. The cycling shoe of claim 1, wherein said fastening system further comprises one said tensioning device on each side of the upper, and each said tensioning device is configured to cooperate with one of the first and second connecting elements as a pair.

4. The cycling shoe of claim 3, wherein each tensioning device and connecting element pair comprises a hook and loop fastener.

5. The cycling shoe of claim 3, wherein each said tensioning device and connecting element pair comprises a ratchet cinch.

6. The cycling shoe of claim 1, wherein the first and second connecting elements are connected to form a continuous connecting member.

7. The cycling shoe of claim 6, wherein the continuous connecting member passes through passages on sides of the upper and is provided to one said tensioning device.

8. The cycling shoe of claim 1, wherein the connection of the lower heel portion extends over an amount of curvature of the curved rear heel end of the sole sufficient to provide the bistable open and closed states.

9. The cycling shoe according to claim 7, wherein the continuous connecting member comprises an elastic cord and the one tensioning device on the upper restrains movement of the cord through the one tensioning device to the extent that cord is inserted into the one tensioning device such that the heel portion is held in tension relationship with the upper.

10. The cycling shoe according to claim 1, wherein the sole has a stiffness index of about 5.0 or greater.

11. The cycling shoe according to claim 1, wherein the sole comprises carbon fiber material.

12. The cycling shoe according to claim 1, wherein the heel pivots about an axis substantially orthogonal to a longitudinal axis of the sole.

13. The cycling shoe according to claim 1, wherein with the heel in said closed state, the first and second peripheral edge portions respectively face the first and second lateral sides of the heel, and an area between the first peripheral edge portion of the upper and the first lateral side of the heel, and an area between the second peripheral edge portion of the upper and the second lateral side of the heel, are substantially open, and each said open area extends at least substantially entirely to the sole.

14. A cycling shoe, comprising: a sole having an inner side and an outer side, said inner side including a toe section, a ball section, an arch section, and a heel section, and said outer side including a mounting section including plural orifices for connecting a cleat; an upper connected to the sole to form a cavity for receiving a foot of a cyclist; a heel including a first lateral side, a second lateral side, a lower heel portion connected to the heel section of the sole, and an upper heel portion pivotable to selectively rotate the heel into bistable open and closed states of the heel with respect to the sole about a pivot area of the lower heel portion, a concave portion of an interior surface of the heel in the closed state transforms to be a convex portion of said interior surface in the open state in a transition of the heel from the closed state to the open state, the heel including a first energy barrier between the open state and the closed state and a second energy barrier between the closed state and the open state, and the heel remains in the open state until moved to overcome the first energy barrier and placed into the closed state and remains in the closed state until moved to overcome the second energy barrier and placed into the open state; and a fastening system including a first connecting element extending from said first lateral side, a second connecting element extending from said second lateral side, and at least one tensioning device on the upper, said at least one tensioning device cooperating with the first and second connecting elements to provide a tension relationship between the heel in said closed state and the upper.

15. The cycling shoe of claim 14, wherein the upper and heel are separate from each other.

16. The cycling shoe of claim 14, wherein said fastening system further comprises one said tensioning device on each side of the upper, and each said tensioning device is configured to cooperate with one of the first and second connecting elements as a pair.

17. The cycling shoe of claim 16, wherein each tensioning device and connecting element pair comprises a hook and loop fastener.

18. The cycling shoe of claim 16, wherein each said tensioning device and connecting element pair comprises a ratchet cinch.

19. The cycling shoe of claim 14, wherein the first and second connecting elements are connected to form a continuous connecting member.

20. The cycling shoe of claim 19, wherein the continuous connecting member passes through passages on sides of the upper and is provided to one said tensioning device.

21. The cycling shoe of claim 14, wherein the connection of the lower heel portion to the heel section of the sole is curved in correspondence with an amount of curvature of the heel section of the sole sufficient to provide the bistable open and closed states.

22. The cycling shoe according to claim 14, wherein the first and second connecting members comprise an elastic cord and said at least one tensioning device on the upper restrains movement of the cord through said at least one tensioning device to the extent that cord is inserted into said at least one tensioning device such that the heel held in tension relationship with the upper.

23. The cycling shoe according to claim 14, wherein the heel section of the sole includes a curved rear heel end, the connection of the lower heel portion is curved as a result of the connection extending along a portion the curved rear heel end, and with the heel in said open state, said interior surface the lower heel portion flexes to form a crease including the convex surface in the pivot area of the lower heel portion.

24. The cycling shoe according to claim 14, wherein the heel pivots about an axis substantially orthogonal to a longitudinal axis of the sole.

* * * * *